United States Patent [19]

Carr

[11] Patent Number: 4,498,366

[45] Date of Patent: Feb. 12, 1985

[54] CLAMPING TUNING MACHINE

[76] Inventor: Stephen P. Carr, 67 Singing Wood Dr., Holbrook, N.Y. 11741

[21] Appl. No.: 594,845

[22] Filed: Mar. 29, 1984

[51] Int. Cl.[3] ..... G10D 3/14

[52] U.S. Cl. ..... 84/304; 84/200; 84/306

[58] Field of Search ..... 84/200–201, 84/204, 304–306

[56] References Cited

U.S. PATENT DOCUMENTS 534,063 2/1895 Hafer et al. ..... 84/304

554,057 2/1896 Durkee ..... 84/304

4,141,271 2/1979 Mullen ..... 84/312 P

*Primary Examiner*—Lawrence R. Franklin

*Attorney, Agent, or Firm*—Leonard Belkin

[57] ABSTRACT

A tuning machine for a stringed musical instrument employing posts for adjusting the tension of the strings. The posts are split so that each string is clamped passing through the post rather than relying on the friction of the string wrapped around the post. This construction results in the string remaining properly tuned for a longer period of time than in the wrapped arrangement presently in use.

6 Claims, 5 Drawing Figures

FIG. 1
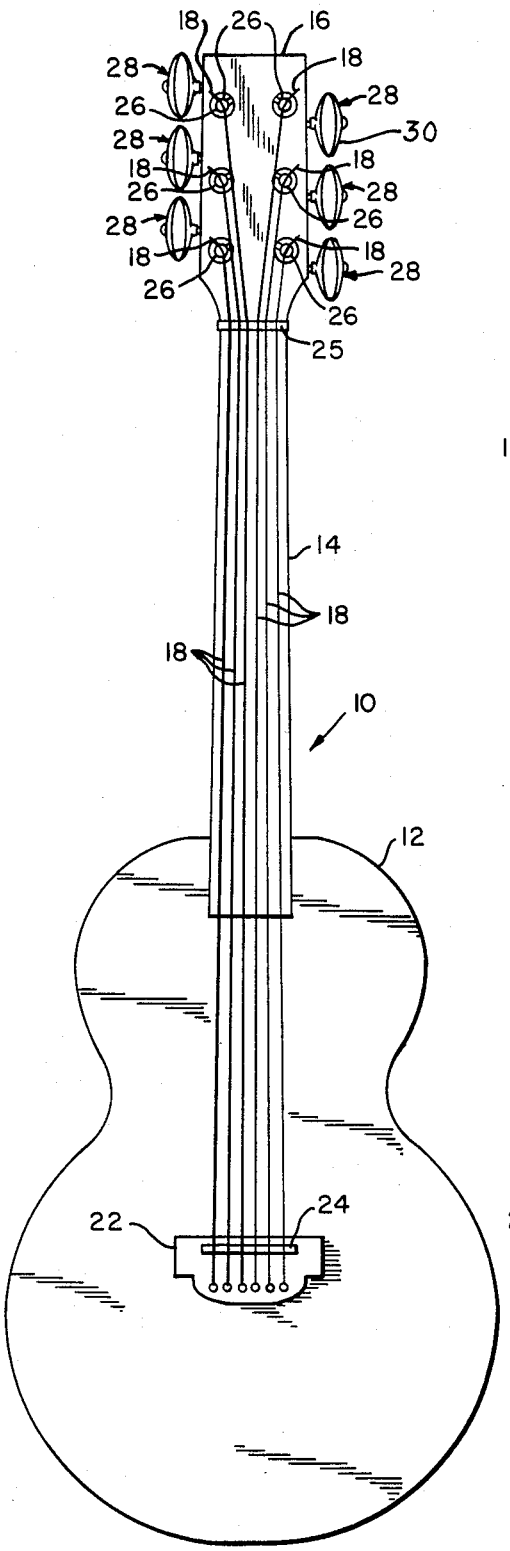
FIG. 2
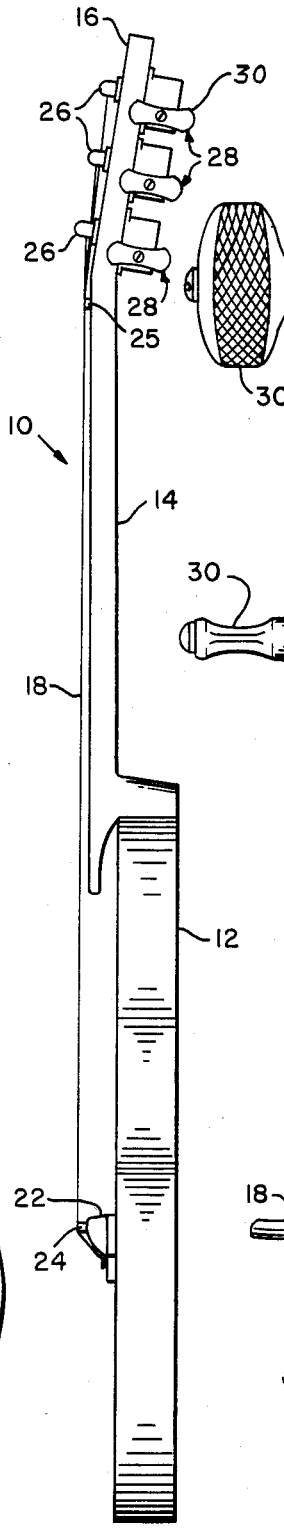
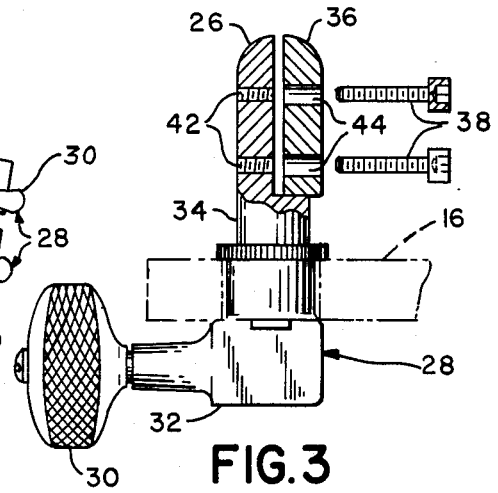
FIG. 3
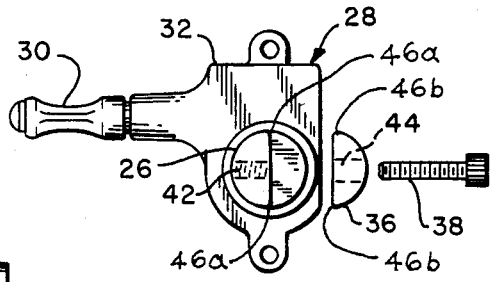
FIG. 4
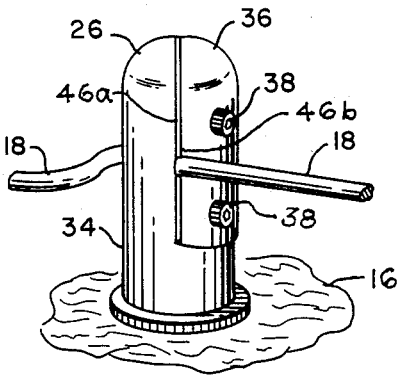
FIG. 5

CLAMPING TUNING MACHINE

BACKGROUND OF THE INVENTION

This invention relates to a tuning machine for stringed musical instruments and particularly to a tuning machine which relies primarily on clamping the end of each string rather than relying on the friction of the string wound in multiple loops around the tuning peg or post.

In guitars and other stringed musical instruments, strings of different thickness are stretched across a bridge over a resonant box. The strings terminate on revolving pegs or posts on a headstock connected to the box. Each string is separately tuned to a note on an appropriate key by rotating the post to adjust the tension. In playing the instrument, the musician effectively alters the length of each string by pressing the string with a finger against a fret to shorten the string lengths and produce the vibrational frequency associated with the selected note.

The mechanism incorporated in the headstock to rotate each post and adjust string tension is referred to as a tuning machine. A finger operated tuning key is provided for each post and a gear mechanism of some type is provided to transmit the rotation of the key to the post. Typically the mechanism would be a worm gear arrangement, although in some instruments a planetary gear construction may be employed. These devices have mechanical advantages as high as 14 or 16 to one, so that the key has to be turned 14 or 16 complete revolutions to obtain one complete rotation of the post. For all practical purposes the mechanism is irreversible so that once the key is set to the desired tension of the string the string in theory should retain the tension.

However, in arrangements of the type just described, the strings are held in place on the posts by the accumulated friction of the string wound several times on the post with the end threaded through an opening, as illustrated in U.S. Pat. Nos. 490,564, 631,118, 778,128, 922,921, 2,173,800, and 3,240,098.

It is well known among musicians who play such instruments that the strings gradually lose some of their tension thus altering their pitch, and so must be returned at frequent intervals. Rough treatment of the strings can also result in their going out of tune. A major factor in the change of tension in such strings is due to wrapping of the ends of the strings around the posts, presumably due to slippage of the strings on the post overcoming the friction on which is relied to maintain the tension. That is, when the posts are rotated to adjust the strings to obtain the desired tension, there is a lag due to friction of the application of the tension over the portion of the string wrapped around the post. Over a period of time the tension of this portion of the string does adjust with the result that there is an alteration of the tension in the portion of the string stretched over the resonant box, resulting in the string becoming out of tune.

Prior attempts to clamp a string over less than one complete rotation on the post in order to avoid the use of winding have resulted in damage to the string and presented other problems, so that the multi-turned string on the post remains the predominant construction to terminate the string.

SUMMARY OF THE INVENTION

The present invention overcomes or reduces the problems noted above by making it possible to terminate each of the strings on its post with less than one complete turn without causing damage to the string. In accordance with a preferred embodiment of this invention there is provided a tuning machine for a stringed instrument having a post on which a string is terminated, a tuning key, and a mechanism for transmitting the turning motion of the key to the post with sufficient mechanical advantage so as to be effectively irreversible. The string post is split or segmented into a main body and a removable matching clamping segment which when connected together clamp the end of the string with sufficient force as to make it possible for the string to terminate on the post and permit tension adjustment with less than one complete turn on the post to bring the string to normal pitch. Clamping is accomplished over a sufficient length of the string to avoid concentrating the clamping force thereby avoiding any damage to the string. In this construction, the string remains at proper tension and thus in tune longer than in present arrangements where the string is wound on the post.

It is thus a principal object of this invention to provide a tuning machine for stringed instruments having improved retention of the selected tension on the string.

Other objects and advantages of this invention will hereinafter become obvious from the following description of preferred embodiments of this invention.

BRIEF DESCRIPTION OF THE DRAWING

FIG. 1 is a top view of a guitar embodying the principles of this invention.

FIG. 2 is a side view of the guitar shown in FIG. 1.

FIG. 3 is an elevation view in partial section of a tuning machine as used in FIGS. 1 and 2 with an exploded view of the post.

FIG. 4 is a top view of the machine shown in FIG. 3 with an exploded view of the post.

FIG. 5 is an isometric view of a string post with the end of a string attached.

DESCRIPTION OF THE PREFERRED EMBODIMENT

Referring to FIGS. 1 and 2, there is shown a guitar in which a preferred embodiment of this invention has been incorporated.

As is understood in the art, guitar 10 consists of a body 12 which comprises the resonant box, a neck 14, and a headstock 16. The frets on neck 14 are not illustrated. Six strings 18 are connected in conventional fashion at one end to a bridge 22 mounted on body 12 and are drawn over a saddle bone 24 mounted on bridge 22. Strings 18 are each of a different diameter to obtain the various musical notes and some may be of multilayer construction.

The other ends of strings 18 pass over a nut 25 and are connected to string posts 26 which are part of the tuning machine 28 comprising this invention shown in greater detail in FIGS. 3 and 4.

Tuning machines 28 are located within headstock 16 with string posts 26 extending out to engage strings 18 and tuning keys 30 extending out the side for use by the musician to adjust the tension of each of strings 18.

Each tuning machine, as best seen in FIGS. 3 and 4, consists of a housing 32 from which protrudes at right angles to each other the string post 26 and tuning key 30. Key 30 is flat to permit the musician to grasp it with his fingers and rotate it. Within housing 32 is a gearing arrangement of conventional design not forming part of this invention to rotate post 26 in response to the rotation of tuning key 30.

A large mechanical advantage, typically 14 or 16 to one in favor of key 30 is provided within the gearing arrangement so that key 30 would have to make 14 or 16 complete turns to rotate post 26 only once. This large mechanical advantage renders the mechanism irreversible so that tension on string 18 will not cause rotation in the opposite direction and avoids the necessity to provide a positive lock. In addition, large tensile forces can be imparted to strings 18 with only slight effort on tuning keys 30.

The gear mechanism within housing 32 typically would be of worm gear construction as shown in one of the aforementioned patents and instruments now on the market or a planetary gear system found in other musical instruments.

String post 26 incorporating the features of this invention, as seen in FIGS. 3, 4, and 5, consists of a main body 34 of circular cross section with a removable clamping segment 36. With the latter mounted on the former as seen in FIG. 5 there is formed a cylindrical member, comprising post 26 with the heads of a pair of bolts 38 protruding .

As shown in FIG. 3, main body 34 is provided with a pair of axially spaced threaded holes 42. The latter would each be along a diameter of the cross section of post 26 axially aligned in order to provide a uniform force on its string as will be seen later.

Segment 36 is provided with a pair of unthreaded holes 44 sufficiently large enough to accommodate threaded bolts or screws 38 which would pass through holes 44 and engage threaded holes 42. Bolts 38 may be provided with Allen-type heads to permit the use of an Allen wrench to tighten them in place, although of course other configurations may be employed.

It is important that the facing surfaces of main body 34 and segment 36 be smooth and match uniformly, such as planar surfaces, to distribute the clamping force uniformly over the length of string 18 between body 34 and segment 36. Also, edges 46*a* and 46*b* of the post and segment are rounded and polished to avoid any possible string damage.

As shown in FIG. 5, string 18 extends through post 26 between main body 34 and clamping segment 36. When bolts 38 are tightened then string 18, passing between bolts 38, is held in place. Under some circumstances it may be desirable to provide posts 26 having an oval or other suitable cross section.

In the use of the apparatus just described, each string 18, one at a time, is pulled through the space between body 34 and segment 36 and held tense while bolts 38 are tightened to hold string 18 securely. Then tuning key 30 is rotated to obtain the desired tension. It has been found that in this arrangement, less than one complete turn of post 26 is required to obtain the desired tension, and in many cases less than one half a rotation is all that is required.

With the invention as described, strings 18 stay in tune for a much longer period than is obtained in present devices where the strings are wound on the string posts and will endure a substantial amount of rough usage without going out of tune. In addition, it is possible to vary the angle of strings 18 off nut 25 by locating the string placement through post 26. This permits a fine adjustment of string tension by sliding the string axially along post 26 as nuts 38 are tightened so as to eliminate false tones.

While only one preferred embodiment of this invention has been described, it is understood that many other variations are possible without departing from the principles of this invention as called for in the claims which follow.

What is claimed is:

1. A tuning machine for a stringed musical instrument comprising post means for terminating a string, a tuning key, and means for transmitting rotational force of said tuning key to cause rotation of said post means with sufficient mechanical advantage to effectively render said transmitting means irreversible, said rotation of said post means caused by rotation of said key permitting selective adjustment of the tension in said string, the improvement comprising wherein said post means comprises a main body and a removable clamping segment, said main body and segment having matching mating surfaces to clamp said string over an extended length of said string thereby minimizing damage to said string, and means for actuating said segment on said main body to permit clamping of the end of said string with sufficient force so as to permit termination and tension adjustment of said string by said tuning key with less than 360 degree wraparound of said string on said post means, said actuating means including threaded means for adjustably clamping said segment to said main body, a pair of spaced holes in said segment, a pair of spaced threaded holes in said main body aligned with said spaced holes, and threaded bolts to pass through said spaced holes and threaded into said threaded holes to permit tightening of said segment to said main body for clamping the string passing therethrough.

2. The tuning machine of claim 1 in which said post means is circular in cross section and said segment is a portion of said post split axially along a diameter of said post.

3. The tuning machine of claim 2 in which the facing surfaces are planar.

4. The tuning machine of claim 2 in which said pairs of spaced holes pass through the central axis of said post means and said holes extend through diameters of said post means.

5. The tuning machine of claim 2 in which the edges of said main body and said segment are rounded.

6. The tuning machine of claim 2 in which said post means is circular in cross section.

* * * * *